US006571854B1

(12) United States Patent
Palmer et al.

(10) Patent No.: US 6,571,854 B1
(45) Date of Patent: Jun. 3, 2003

(54) METHOD AND APPARATUS FOR FIXING THE LENGTH OF A PULL CORD

(75) Inventors: Roger C. Palmer, Greensboro, NC (US); David A. Schwartz, High Point, NC (US); Zazu Cicua, Jamestown, NC (US)

(73) Assignee: Newell Window Furnishings, Inc., Freeport, IL (US)

( * ) Notice: Subject to any disclaimer, the term of this patent is extended or adjusted under 35 U.S.C. 154(b) by 0 days.

(21) Appl. No.: 09/648,704

(22) Filed: Aug. 25, 2000

(51) Int. Cl.[7] ..... E06B 9/324

(52) U.S. Cl. ..... 160/178.2 R; 160/173 R; 24/115 H; 24/129 R

(58) Field of Search ..... 160/178.2 R, 178.1 R, 160/168.1 R, 173 R, 405; 24/115 H, 129 R, 129 D

(56) References Cited

U.S. PATENT DOCUMENTS 2,494,759 A * 1/1950 Hirschy ..... 160/178.2 R
2,939,528 A * 6/1960 Schultz ..... 160/168.1 R
3,952,789 A * 4/1976 Marotto ..... 160/168.1 R
4,327,797 A * 5/1982 Nakajima et al. ..... 160/168.1 R
4,336,834 A * 6/1982 Schaller ..... 160/168.1 R
4,739,815 A * 4/1988 Altman ..... 160/84.01
4,982,776 A 1/1991 Kuhar et al.
5,724,710 A * 3/1998 Hancock ..... 24/129 D
6,453,974 B1 * 9/2002 Lai et al. ..... 160/173 R

* cited by examiner

*Primary Examiner*—David M. Purol
(74) *Attorney, Agent, or Firm*—Marshall, Gerstein & Borun

(57) ABSTRACT

An adjustable cord restraining device for a blind assembly having a head rail, a bottom rail and at least one pull cord extending through a cord passage of the head rail and coupled to the bottom rail includes an annular member sufficiently sized to prevent entry of the annular member into the cord passage of the head rail and further travel of the pull cord through the head rail. A method of preventing the further extension of a pull cord includes obtaining an annular member sized larger than a pull cord passageway of a head rail pinching a mid-section of the pull cord and inserting the pinched portion of the mid-section through the annular member, forming a loop with the pull cord, inserting a free end of the pull cord through the loop to form an adjustable knot.

4 Claims, 6 Drawing Sheets

FIG. 1
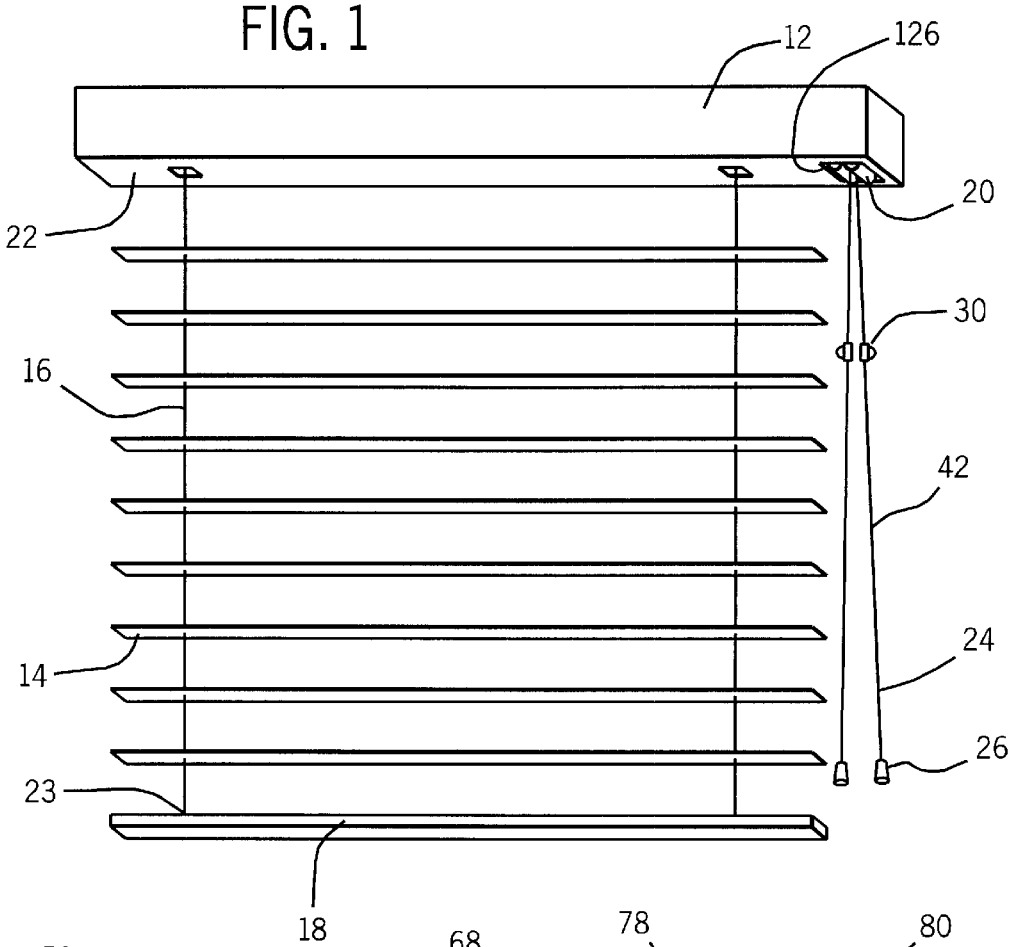
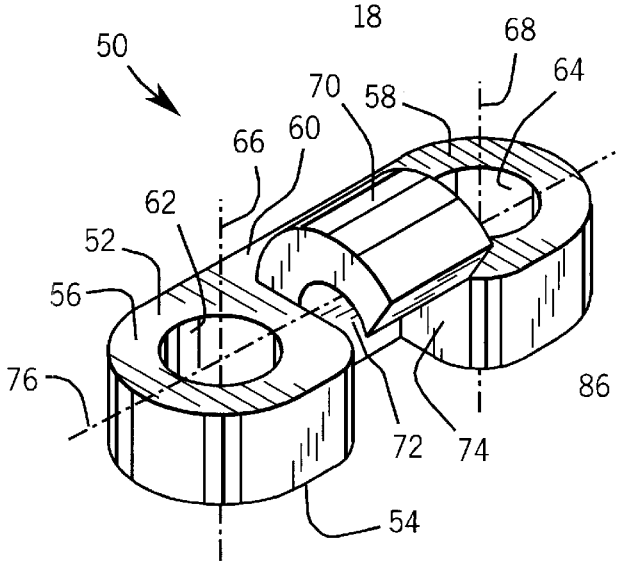
FIG. 5
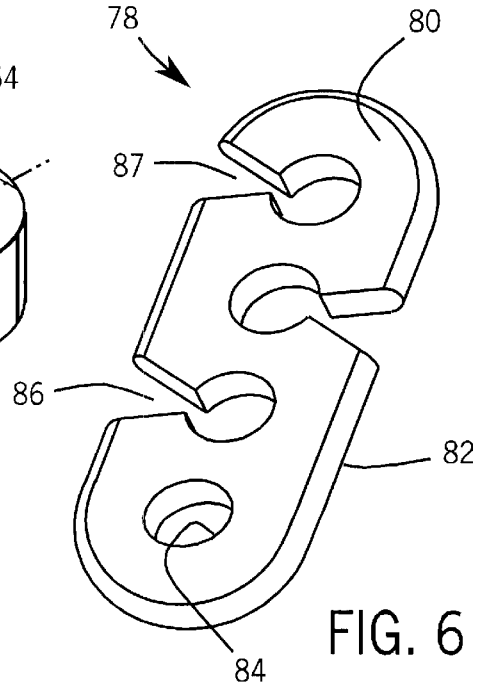
FIG. 6

FIG. 7
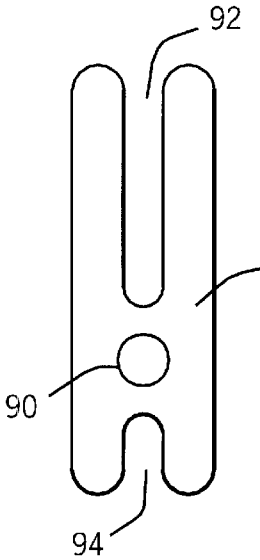
FIG. 8
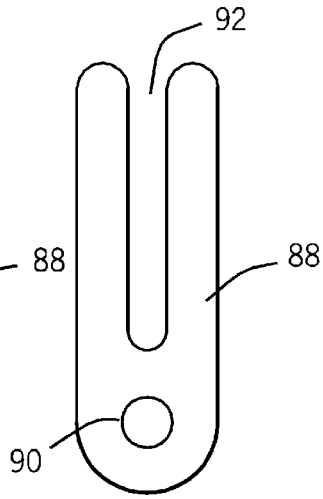
FIG. 9
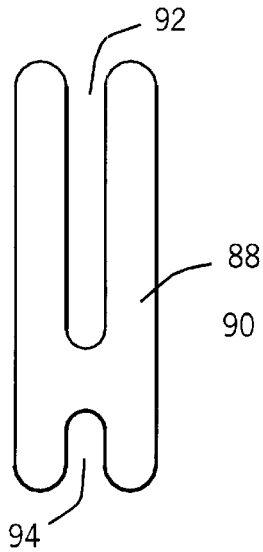
FIG. 10
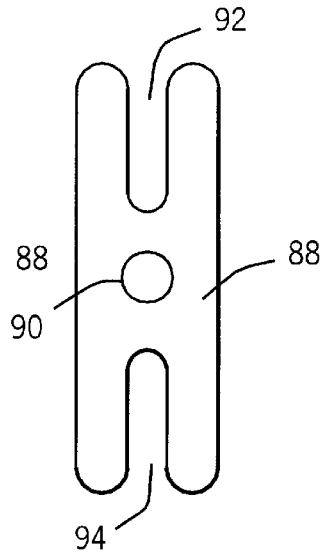
FIG. 12
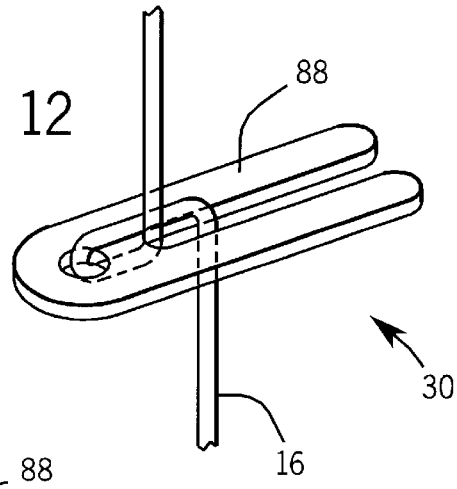
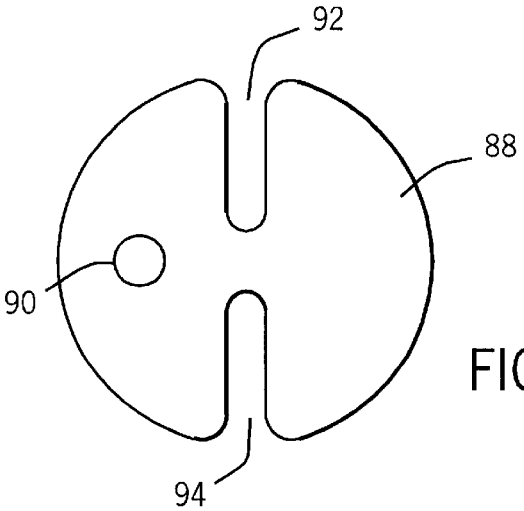
FIG. 11

FIG. 13
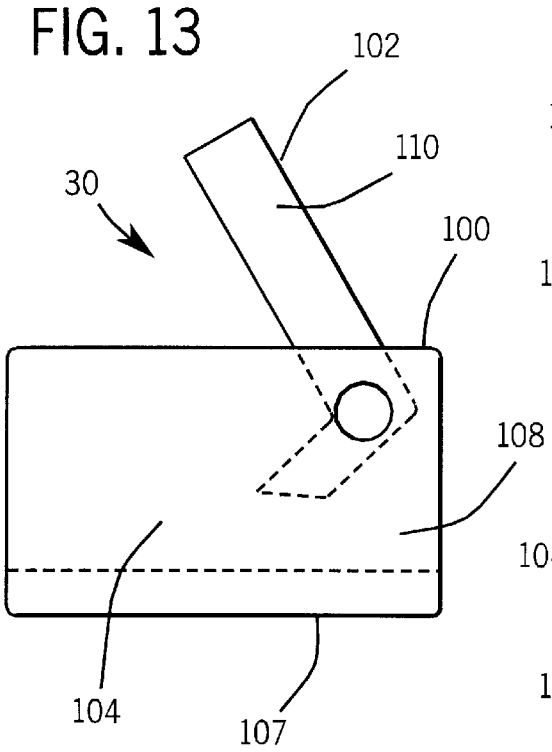
FIG. 14
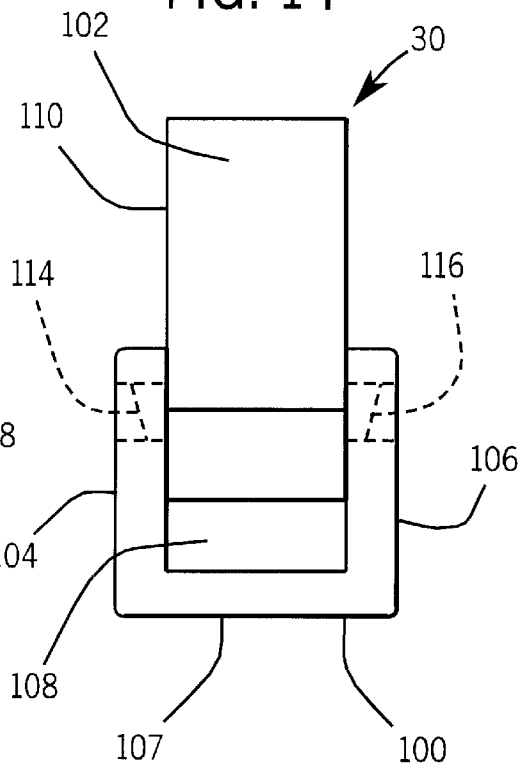
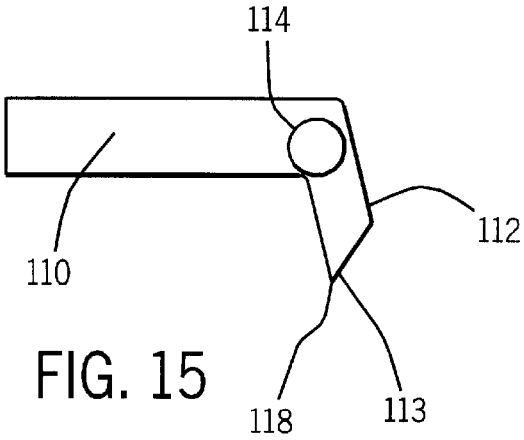
FIG. 15
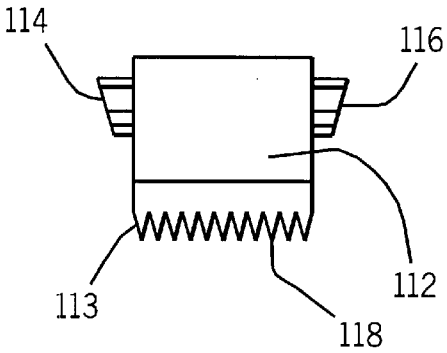
FIG. 16

METHOD AND APPARATUS FOR FIXING THE LENGTH OF A PULL CORD

FIELD OF THE INVENTION

The present invention relates generally to pull cord restraining devices for window coverings, more particularly, to a method and apparatus for fixing the length of a pull cord to protect children from injury resulting from such cords.

BACKGROUND OF THE INVENTION

Window coverings, such as horizontal blind assemblies, typically include pull cords to extend or retract the height of the blinds with respect to the window. Horizontal blind assemblies also typically include a head rail positioned adjacent to the top of the window and a plurality of equally spaced, parallel horizontal slats or louvers positioned below the head rail. In most horizontal blind assemblies, two pull cords downwardly extend from the head rail through the slats or louvers and form a U-shape or a loop around the bottommost slat or a bottom rail. One of the downwardly extending cords adjusts the horizontal positioning of one end of the bottommost slat or bottom rail of the blind assembly and the other cord adjusts the other end of the same slat or rail. The opposite free ends of the pull cords typically downwardly extend from an end portion of head rail to form a looped end or multiple single free ends knotted together or enclosed by one or more tassels. The head rail of the blind assembly typically includes a manually activated cord lock mechanism for fixing the length of the pull cords extending through the slats or louvers of the blind assembly to the bottommost slat or bottom rail. When activated, the pull cords and bottom-most slat or bottom rail are prevented from further downwardly extending from the head rail.

Unfortunately, pull cords present dangers for small children. Small children have been known to play with the pull cords which often includes pulling on such cords. When children pull on and play with the pull cords, their heads may become entangled in the cords increasing the risk of serious injury and strangulation. According to the Consumer Product Safety Commission, more than 140 children have died in the United States by strangulation from pull cords since 1981.

A number of solutions have been proposed to reduce this risk of injury and strangulation. One proposed solution is to no longer form or tie the free ends of the pull cords together to create a loop or a knot. Another proposed solution employs the use of break away tassels which break apart when a force is applied to the loop, created by the tassel, to separate the free cord ends of the pull cords. Yet another proposed solution involves the use of a housing to substantially cover the free sections or free ends of the pull cords to prevent children from accessing the cords.

Existing blind assemblies and the proposed solutions to reduce the risk of injury and strangulation from the pull cords of blind assemblies have a significant drawback. Existing cord lock mechanisms within the head rails of blind assemblies require manual activation of the cord lock to fix the height of the blind assembly and the length of the pull cords downwardly extending from the head rail. A standard cord lock locks the pull cord, in part, due to the tension in the cord provided by the weight of the bottom rail. However, when the bottommost slat or the bottom rail of the blind assembly is extended such that it is resting on the sill of the window or a similar support structure, the cord lock mechanism is not typically activated to fix the height of the blind assembly. As a result, a child can easily grasp one of the pull cords extending through the slats of the blind assembly, pull out a section of the pull cord out from the blinds of the blinds assembly, and increase the length of the pull cord extending from the head rail through the slats. The increased length of the pull cord significantly increases the risk of serious injury or strangulation to the child resulting from entanglement with the cord.

Further, the existing proposed solutions to reduce the risk of injury and strangulation to children have generally been focused on the free segments or free ends of the pull cords and have not been focused on fixing the length of the cords extending through the blinds of the blind assembly to prevent a child from pulling the pull cord out from the slats of the blind assembly. As a result, a significant risk of injury or strangulation remains for small children coming into contact with a blind assembly in an extended position with the bottommost slat or bottom rail resting on a sill or a support and the cord lock in an unlocked or non-fixed position.

Accordingly, it would be advantageous to provide a window covering that overcomes this disadvantage of existing blind assemblies. In particular, it would be advantageous to provide a pull cord restraining device that adjustably fixes the length of the pull cords of the blind assembly when the blind assembly is in an extended position with the bottommost slat or the bottom rail resting on a sill or support. What is needed is a pull cord restraining device that is inexpensive and adapted for use with new or existing blind assemblies. What is also needed is a pull cord restraining method or apparatus that is easy to install and operate.

SUMMARY OF THE INVENTION

The present invention provides an adjustable stop for a blind assembly having a head rail, a bottom rail and at least one pull cord extending through a cord passage of the head rail and coupled to the bottom rail. The stop includes an annular member having an axis and first and second ends. The annular member defines an opening extending along the axis from the first end to the second end. The opening has a substantially continuous cross-sectional area transverse to the axis. The annular member is sufficiently sized to prevent entry of the annular member into the cord passage of the head rail. The opening of the annular member is configured to receive a mid-section of the cord. A portion of the mid-section extending through the annular member and the annular member forms a loop which is configured to receive an end of the pull cord to form an adjustable knot with the annular member. The annular member configured to engage the head rail to prevent further travel of the pull cord through the head rail.

The present invention also provides a method of preventing the further extension of a pull cord from a blind assembly positioned in an extended position with a bottom rail of the blind assembly resting on a support for reducing the risk of strangulation resulting from a small child pulling on and becoming entangled with the pull cord. The method includes obtaining an annular member sized larger than a pull cord passageway of a head rail of the blind assembly and positioning one of opposing first and second ends of the annular member adjacent to a mid-section of the pull cord. The method further includes pinching the mid-section of the pull cord and inserting the pinched portion of the mid-section through an opening defined in the annular member. The opening has a substantially continuous transverse cross-sectional area and extending along an axis from the first end to the second end of the annular member. The method further includes forming a loop with the pinched portion of the mid-section and the annular member, inserting a free end of the pull cord through the loop, pulling on the free end to form an adjustable knot in the pull cord with the annular member, and adjusting the knot to the desired position along the pull cord.

The present invention also provides a blind assembly for a structure. The blind assembly includes a head rail, a bottom rail, a plurality of slats, at least one pull cord and an annular member. The head rail is adapted for connection to the structure and has a pull cord passageway. The slats are disposed between the head rail and the bottom rail. The annular member defines an opening extending along the axis from the first end to the second end. The opening has a substantially continuous cross-sectional area transverse to the axis. The annular member is sufficiently sized to prevent entry of the annular member into the cord passage of the head rail. The opening of the annular member is configured to receive a mid-section of the cord. The portion of the mid-section extending through the annular member and the annular member forms a loop which is configured to receive an end of the pull cord to form an adjustable stop with the annular member. The annular member configured to engage the head rail to prevent further travel of the pull cord through the head rail.

The present invention also provides a cord lock apparatus for a blind assembly having a head rail, a bottom rail and at least one pull cord. The pull cord is coupled to the bottom rail, extending through the head rail and downwardly extending from one end of the head rail. The apparatus includes a bearing, a friction slider and friction slider travel restriction means. The bearing is coupled to the head rail and supports the pull cord. The friction slider is coupled to the head rail. The head rail has the friction slider travel restriction means for defining the extent of translational movement of the friction slider within the head rail. The restriction means is configured for enabling translation of the friction slider from a first position, in which the friction slider is positioned at least partially below the bearing such that the friction slider contacts a portion of the pull cord generally downwardly extending from the bearing, and a second position, in which the friction slider is disposed adjacent to the bearing such that the pull cord is releasably fixed between the pull cord and the bearing.

The present invention also provides a cord lock apparatus for a blind assembly having a head rail, a bottom rail and at least one pull cord. The pull cord is coupled to the bottom rail, extending through the head rail and downwardly extending from one end of the head rail. The apparatus includes a bearing, at least one slot defined into the head rail, a friction slider and a biasing device. The bearing is coupled to the head rail and supports the pull cord. The friction slider is coupled to the head rail at the slot. The slot is configured to limit the translational movement of the frictional slider within the head rail. The biasing device is coupled to the head rail and is positioned generally below the bearing The biasing device is configured to contact the pull cord and direct the pull cord toward the friction slider.

The present invention also provides a cord restraining device for a blind assembly having a head rail, a bottom rail and at least one pull cord extending through a cord passage of the head rail and coupled to the bottom rail. The device includes a frictional clip having at least one opening for receiving one end of the cord. The frictional clip is configured to adjustably and frictionally engage the cord. The frictional clip is sufficiently sized to prevent entry of the frictional clip into the cord passage of the head rail. The frictional clip is configured to prevent further travel of the pull cord into the cord passage of the head rail, thereby fixing the length of a portion of the pull cord downwardly extending from the head rail to the bottom rail for preventing a child from pulling the portion of the pull cord out from the blind assembly.

The present invention also provides a cord restraining device for a blind assembly having a head rail, a bottom rail and at least one pull cord extending through a cord passage of the head rail and coupled to the bottom rail. The device includes a generally U-shaped frame forming a channel and a locking plate. The locking plate is pivotally coupled to the frame and is configured to fit within the channel. The frame and the plate define a cord opening. The plate has a first portion and a second portion obliquely extending from the first portion. The second portion includes a cord engaging edge. The locking plate is configured for pivotal movement between a first position, in which the cord freely slides through the cord opening, and a second position, in which the cord engaging edge of the second portion crimps the cord to lock the device to the cord. The device is sufficiently sized to abut against the head rail of the blinds thereby preventing entry of the device and further travel of the cord into the cord passage of the head rail.

BRIEF DESCRIPTION OF THE DRAWINGS

FIG. 1 is a front perspective view of one exemplary embodiment of a blind assembly of the present invention;

FIG. 5 is a perspective view of a cord restraining device for a blind assembly of the present invention;

FIG. 6 is a perspective view of an alternative exemplary embodiment of a cord restraining device for a blind assembly;

FIG. 7 is a perspective view of an alternative exemplary embodiment of a cord restraining device for a blind assembly;

FIG. 8 is a perspective view of an alternative exemplary embodiment of a cord restraining device for a blind assembly;

FIG. 9 is a perspective view of an alternative exemplary embodiment of a cord restraining device for a blind assembly;

FIG. 10 is a perspective view of an alternative exemplary embodiment of a cord restraining device for a blind assembly;

FIG. 11 is a perspective view of an alternative exemplary embodiment of a cord restraining device for a blind assembly;

FIG. 12 is a perspective view of the cord restraining device of FIG. 8 including a pull cord;

FIG. 13 is a side view of an alternative exemplary embodiment of a cord restraining device for a blind assembly;

FIG. 14 is a front view of the cord restraining device of FIG. 13;

FIG. 15 is a side view of a locking plate of the cord restraining device of FIG. 13;

FIG. 16 is a front view of the locking plate of FIG. 15;

DETAILED DESCRIPTION OF THE PREFERRED EMBODIMENTS

Figure 2:
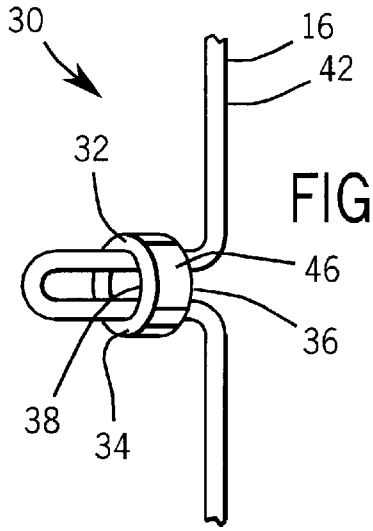
FIG. 2 is a perspective view of an adjustable stop for a blind assembly of the present invention.

FIG. 1 is a front perspective view of a horizontal blind assembly 10 for covering a window or a door (not shown). Blind assembly 10 includes a head rail 12, a plurality of equally spaced, parallel slats 14, pull cords 16, and a bottom rail 18,also referred to as the bottom-most slat. Head rail 12 is an elongate frame. Head rail 12 is adapted to connect to a structure adjacent to the top of the window. In an exemplary embodiment, head rail 12 is positioned within or behind a valance assembly (not shown). Head rail 12 provides a structure for supporting slats 14 and the valance. Head rail 12 also substantially encloses and slidably supports a portion of pull cord 16 and at least one cord lock assembly 20. In an exemplary embodiment, head rail 12 is made out of metal. Alternatively, head rail 12 can be made of other materials, such as plastic, wood, aluminum, etc. In an exemplary embodiment, head rail 12 is an enclosed frame to prevent debris, dirt or moisture from entering the area within head rail 12 and head rail 12 has at least one opening 126 on a lower surface 22 of head rail 12 for enabling a free-hanging section 42 of pull cord 16 to extend in and out of head rail 12. In an alternative exemplary embodiment, head rail 12 includes an opening (not shown) substantially extending along the length of lower surface 22 of head rail 12. In an alternative exemplary embodiment, cord lock 20 is disposed within a cord lock housing coupled to head rail 12.

Slats 14, also referred to as louvers, are flat or curved elongate plates equally spaced apart and horizontally positioned in a parallel configuration with respect to each other. Slats 14 are positioned generally below head rail 12 and above bottom rail 18. Slats 14 can be made of a variety of material including plastic, metal, wood, etc. In an exemplary embodiment, each slat 14 includes openings (not shown) for enabling pull cords 16 to extend through slats 14.

Pull cords 16 are elongate cables, each having a bottom rail end 23 and a free end 24. Bottom rail ends 23 of pull cord 16 are coupled to bottom rail 18. In an exemplary embodiment, bottom rail ends 23 loop around bottom rail 18. Pull cords 16 upwardly extend from bottom rail 18 through slats 14, and into and along head rail 12, through cord lock 20, and then downwardly extend from one end of head rail 12 toward free ends 24. Free ends 24 of pull cords 16 are preferably contained in at least one tassel 26. Pull cords 16 are slidably and adjustably coupled to head rail 12. Pull cords 16 provide an adjustable means for varying the height of the blind assembly 10 and the extension or retraction of slats 14 relative to the window. In an exemplary embodiment, each pull cord 16 includes an adjustable cord restraining device 30.

Figure 3:
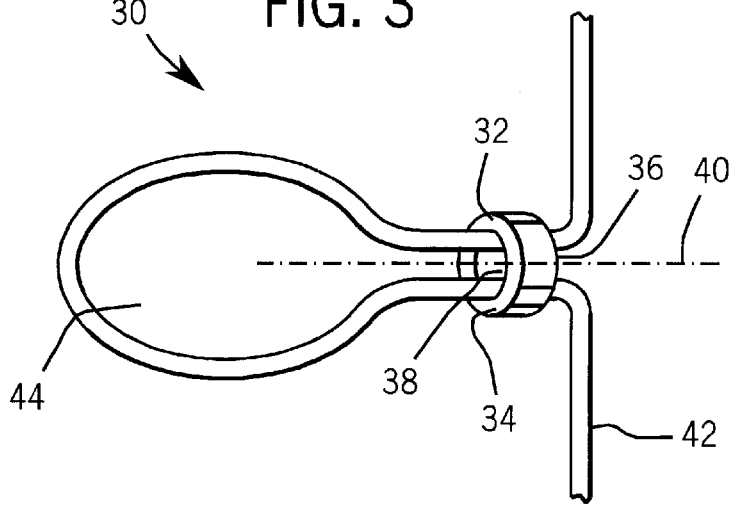
FIG. 3 is a perspective view of the stop of FIG. 2.
Figure 4:
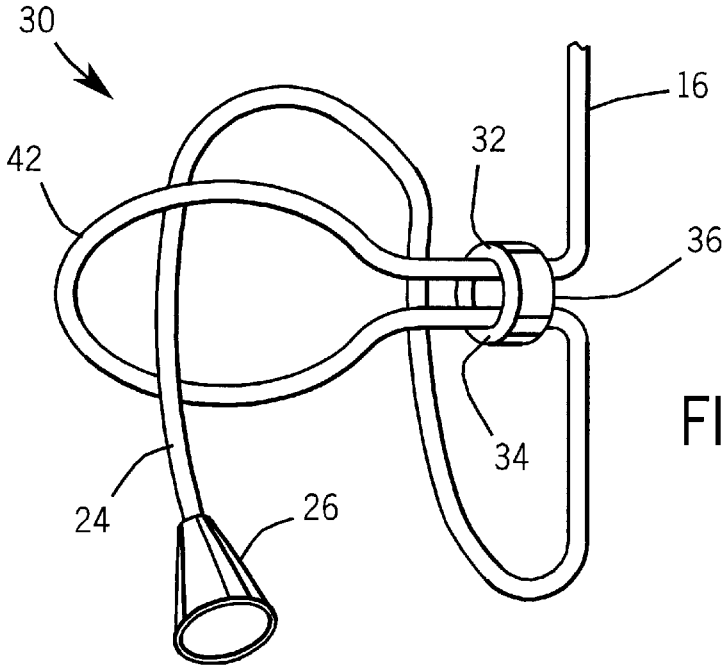
FIG. 4 is a perspective view of the stop of FIG. 2.

FIGS. 2 through 4 illustrate one exemplary embodiment of cord restraining device 30. In FIGS. 2 through 4, cord restraining device 30 is an annular member 32. Annular member 32 has first and second ends 34 and 36 and an opening 38. Opening 38 extends along an axis 40 (see FIG. 3) from first end 34 to second end 36. Opening 38 has a substantially continuous cross-sectional area transverse to axis 40. Opening 38 of annular member 32 is configured to receive and slidably engage a free-hanging mid-section 42 of pull cord 16. As illustrated in FIGS. 3 and 4, annular member 32 is slidably engaged to pull cord 16 through loop 44 formed by a portion of free-hanging section 42 of pull cord 16 extending through annular member 32. Loop 44 is configured to receive free end 24 of pull cord 16, including tassel 26, to form an adjustable knot along pull cord 16 with annular member 32.

The adjustable knot formed with annular member 32 is configured to provide an adjustable stop for pull cord 16. Annular member 32 is sufficiently sized to prevent the entry of annular member 32 within opening 126 of cord lock 20 of head rail 12 (see FIG. 1), thereby preventing the further travel of pull cord 16 through head rail 12 and fixing the length of slats 14 and the height of the blind assembly 10 on the window. Annular member 32 is made of plastic. Alternatively, annular member 32 can be made of other materials such as wood, glass, metal, etc. In an exemplary embodiment, annular member 32 is a cylindrical ring. In alternative exemplary embodiments, annular member 32 may be other components, such as a washer, a bead, a band, a tube, etc. In an exemplary embodiment, an outer surface 46 of annular member 32 includes a decorative finish. Annular member 32 can be easily installed onto a new or existing blind assembly 10 (see FIG. 1) thereby enabling annular member 32 to be marketed to a consumer as a separate part, as part of a blind assembly 10 or as a kit.

As illustrated in FIGS. 2 through 4, a method of using annular member 32 to prevent the further extension of pull cords 16 from blind assembly 10 (see FIG. 1), when blind assembly 10 is positioned in an extended position with bottom rail 18 resting on, or just above, a support or a sill (not shown), includes the following steps. Initially, an annular member 32 is obtained which is sized to be larger than the cord passageway formed at opening 126 and through cord lock 20 (see FIG. 18) within head rail 12 of blind assembly 10, so that annular member 32 abuts with head rail 12 when contacting head rail 12. Then, one of opposing ends 34, 36 of annular member 32 is positioned adjacent to section 42 of one pull cord 16. Pull cord 16 is then pinched at free-hanging section 42. The pinched portion of free hanging section 42 is then inserted through opening 38 of annular member 32 from one of first and second ends 34 through the other of first and second ends 34, 36. The pinched portion is extended through annular member 32 to form loop 44 with annular member 32. Free end 24 of pull cord 16, preferably including tassel 26, is then inserted through loop 44 formed by pull cord 16 and annular member 32. Free end 24 of pull cord 16 is then pulled to form an adjustable knot in free-hanging section 42 of pull cord 16, which includes annular member 32.

The knot can then be adjusted to a desired position along pull cord 16 by first holding free end 24 of pull cord 16 with one hand and annular member 32 with the other hand. Then, while maintaining free-hanging section 42 taut, the knot is adjusted by pushing or pulling on annular member 32 along free-hanging section 42 of pull cord 16 until the adjustable knot is positioned at the desired length along free-hanging section 42 of pull cord 16.

Annular member 32 and the formation of the adjustable knot with pull cords 16 is a quick, easy and inexpensive apparatus for adjustably fixing the length of free-hanging section 42 of pull cord 16 to prevent the further travel of pull cord 16 through head rail 12. Fixing the height of blind assembly 10 prevents a child from being able to pull one of pull cords 16 from out between slats 14 of blind assembly 10 and thereby reduces the risk of serious injury or strangulation to such a child. In an alternative exemplary method, the method described above is implemented using two pull cords 16 adjustably engaged with one annual member 32 to form an adjustable knot.

FIGS. 5 through 16 illustrate alternative exemplary embodiments of a cord restraining device. FIG. 5 illustrates one exemplary embodiment of the cord restraining device wherein the cord restraining device is a frictional clip 50. Frictional clip 50 is an elongate body having first and second sides 52, 54, first and second generally tubular end portions 56, 58, and central portion 60. Frictional clip is configured to slidably and adjustably engage free-hanging section 42 of pull cord 16 (see FIG. 1). Frictional clip 50 is sufficiently sized to abut against head rail 12 of blind assembly 10 thereby preventing entry of frictional clip 50 and the further travel of pull cords 16 into a cord passage within head rail 12. Frictional clip 50 is preferably made of plastic. Alternatively, frictional clip 50 can be made of other materials, such as wood, glass, metal, etc. When abutted against head rail 12, frictional clip 50 fixes the length of pull cords 16 and the height of blind assembly 10 along the window and prevents a child from reaches between slats 14 of blind assembly 10 and pulling pull cords 16 out from between slats 14 and thereby significantly reduces the risk of injury or strangulation to such a child.

First and second tubular end portions have first and second openings 62, 64, respectively, extending from first side 52 to second side 54 along parallel axes 66, 68. Openings 62, 64 of first and second tubular end portions 56, 58 preferably have continuous cross-sectional areas transverse to axes 66, 68, respectively. First and second tubular end portions 56, 58 are integrally formed to and spaced apart by central portion 60. First and second tubular end portions 56, 58 are configured to receive end 24 of pull cord 16. In an exemplary embodiment, first and second tubular end portions 56, 58 have cylindrical shaped openings 62, 64. The outer surface of first and second tubular end portions 56, 58 can have a cylindrical or an irregular outer shape.

Central portion 60 integrally connects and spaces apart first and second tubular end portions 56, 58. Central portion 60 includes a wing 70 outwardly extending from first side 52 of frictional clip 50. Wing 70 is integrally formed to central portion 60. Wing 70 outwardly extends from first side 52 of frictional clip 50 and then curves back inward toward first side 52 to form a channel 72. Channel 72 is configured to receive a portion of free-hanging section 42 of pull cord 16. Channel 72 extends along an axis 76 which is oblique or perpendicular to axes 66, 68. In one exemplary embodiment, axis 76 is substantially perpendicular to axes 66, 68.

Free end 24 of pull cord 16 is threaded through tubular end portion 56 from second side 54 toward first side 52. The free end 24 is then routed under wing 70 and through tubular end portion 58 from first side 52 toward second side 54. First and second tubular end portions 56, 58 and wing 70 form a tortuous path through which free end 24 of pull cord 16 is routed such that frictional clip 50 is slidably and adjustably frictionally engaged to free-hanging section 42 of pull cord 16 (see FIG. 1). In an alternative exemplary embodiment, wing 70 can outwardly extend from second side 54 of frictional clip 50.

FIG. 6 illustrates an alternative exemplary embodiment of a cord restraining device, indicated as frictional clip 78. Frictional clip 78 is a generally flat body having a plurality of holes 84 extending from a first side 80 to a second side 82. Frictional clip 78 further includes at least one cutout 86 defined into clip 78, which outwardly extends from at least one of holes 84 to the edge of frictional clip 78. In an exemplary embodiment, frictional clip 78 includes four holes 84 positioned adjacent to one another and extending through frictional clip 78 from first side 80 to second side 82, three of which include cut outs 86, alternately positioned with respect to one another. Frictional clip 78 is configured to slidably and adjustably connect to free-hanging section 42 of pull cord 16 and to abut with head rail 12 to prevent the further travel of pull cord 16 through the head rail 12 and down through the slats 14 to bottom rail 18 (see FIG. 1). Hole 84, without cutout 86, is configured to receive free end 24 of pull cords 16 and remaining holes 84, having cutout 86, are configured to either receive free end 24 of pull cord 16 or to receive free hanging 42 section of pull cord 16 from the side, thereby increasing the flexibility and ease of installation of frictional clip 78 onto pull cord 16. Frictional clip 78 is preferably made of plastic. Alternatively, frictional clip 78 can be made of other materials, such as wood, metal, etc. Frictional clip 78 can be easily, quickly and inexpensively installed onto an existing or a new blind assembly 10 to provide the safety feature of fixing the length of pull cord 16 such that a child cannot pull cords 16 from between slats 14 of blind assembly 10 when blind assembly 10 is in an extended position with bottom rail 18 of blind assembly 10 resting on the window sill or a similar structure. In alternative exemplary embodiments, frictional clip 78 contains two or more holes 84 with at least one hole 84 including cutout 86. Cutout 86 includes a narrow portion 87 having a width that is less than the width of pull cord 16 (see FIG. 1). In this manner, pull cord 16 must be compressed to fit into hole 84 thereby securing pull cord 16 within hole 84.

FIGS. 7 through 11 illustrate additional exemplary embodiments of a cord restraining device, shown as a retaining body 88. Body 88 includes at least one groove 92. Body 88 is configured to slidably and adjustably connect to pull cords 16 to fix the length of pull cords 16 extending through slats 14 to bottom rail 18 of blind assembly 10 (see FIG. 1). Groove 92 of body 88 is configured to receive a free-hanging section 42 of pull cord 16 as pull cord 16 is wrapped around body 88. Body 88 is preferably made of plastic. Alternatively, body 88 can be made of other materials, such as wood, metal, etc. In an exemplary embodiment as illustrated in FIGS. 7, 8, 10 and 11, body 88 further includes one hole 90 extending from a first side of to a second side of body 88. As illustrated in FIG. 12, hole 90 is configured to receive free end 24 of pull cord 16. Free end 24 and the portion of free-hanging section 42 extending through hole 90 is then wrapped into groove 92 and around body 88 to accomplish adjustable engagement with free-hanging section 42 of pull cord 16. In an alternative exemplary embodiment as illustrated in FIGS. 7, 9, 10 and 11, body 88 includes two grooves 92, 94. Each groove 92, 94 is configured to receive from the side a portion of free-hanging section 42 of pull cord 16, as it is wrapped around body 88 for adjustably fixing the length of pull cords 16 within blind assembly 10. In yet another alternative exemplary embodiment, as illustrated in FIGS. 7, 10 and 11, body 88 can include hole 90 and two grooves 92, 94. As illustrated in FIG. 12, hole 90 and grooves 92, 94 provide a path through which free end 24 of pull cords 16 can extend through and wrap around body 88 for fixing the length of pull cords 16. Body 88 can include grooves of various shapes and depths, and hole 90 can be positioned in various locations along body 88, FIGS. 7 through 11 illustrate examples of these various embodiments. Grooves 92, 94 are sized to have a minimum width less than the width of pull cord 16 to frictionally engage pull cord 16.

FIG. 12 illustrates the connection one or more pull cords 16 to body 88. Free end 24 of pull cord 16 extends through hole 90 of body and the portion of free-hanging section 42 of pull cord 16 extending through hole is 90 wrapped around body to slidably and adjustable engage body 88 to free-hanging section 42 of pull cord 16 for fixing the length of pull cord 16.

FIGS. 13 through 16 illustrate another alternative exemplary embodiment of cord restraining device 30, indicated as restraining device 98. Device 98 includes a generally U-shaped frame 100 and a locking plate 102. U-shaped frame 100 is an elongate body having first and second sidewalls 104, 106 spaced apart and connected by a third wall 107. Third wall 107 extends substantially perpendicular to first and second walls 104, 106 to form U-shaped frame 100. First and second walls 104, 106 of frame 100 each include one hole for receiving locking plate 102. Locking plate 102 is pivotally connected to U-shaped frame 100 at the holes. Frame 100 and locking plate 102 form cord opening 108, which is configured to receive one or more free ends 26 of pull cords 16. U-shaped frame and locking plate are preferably made of plastic. Alternatively, U-shaped frame 100 and locking plate 102 can be formed of other materials, such as wood, metal, etc. U-shaped frame 100 is sized larger than the cord lock passage formed at cord lock 20 through opening 126 of head rail 12 to prohibit pull cord 16 from being pulled out through slats 14 when bottom rail 18 is resting on a window sill.

As best shown in FIGS. 15 and 16, locking plate 102 is a lever having a first portion 110, a second portion 112 and a pair of projections 114, 116. Locking plate 102 is pivotally attached to U-shaped frame 100. Locking plate 102 is configured for pivotal movement between a first position, in which pull cord 16 can freely slide through cord opening 108, and a second position, in which pull cord 16 is crimped by second portion 112 of locking plate 102, thereby securely attaching restraining device 98 to pull cord 16.

In an exemplary embodiment, the first portion 110 is an elongate member integrally formed to second member 112 and is configured to extend within a channel formed by U-shaped frame 100. First portion 110 of locking locking plate 102 provides a lever easily accessible to a user for unlocking or locking plate 102 to pull cord 16 disposed within frame 100. Second portion 112 is integrally formed to and obliquely extends from first portion 110. Second portion 112 further includes a cord engaging end 113.

In an exemplary embodiment, cord engaging edge 113 has a plurality of serrations 118 for facilitating the engaging of locking plate 102 to pull cord 16. Projections 114, 116 outwardly extend from opposite sides of second portion 112 of locking plate 102 and are configured to enter into the holes of first and second walls 104, 106 of U-shaped frame 100 to pivotally connect locking plate 102 the frame 100. Locking plate 102 and frame 100 enable restraining device 98 to easily and quickly adjustably attach to free-hanging section 42 of pull cord 16 by routing free end 24 of pull cord 16 through cord opening 108, and adjustably and slidably positioning restraining device 98 to the desired length along free-hanging section 42 of pull cord 16.

Cord restraining devices such as frictional clips 50, 78, body 88 and restraining device 98 provide an easy, quick and inexpensive means for attaching the cord restraining device onto a pull cord 16 of a new or an existing blind assembly 10 (see FIG. 1). The cord restraining devices, are particularly useful for reducing the risk of serious injury or strangulation to a child from coming into contact with a blind assembly 10 in an extended position with bottom rail 18 of blind assembly 10 resting on a window sill or similar structure and cord lock 20 (see FIG. 18) of blind assembly 10 is in an unactivated condition. When blind assembly 10 is in such a condition, pull cords 16 downwardly extending through slats can be pulled on and out from between slats 14 thereby creating a significant risk to the child. The cord restraining devices significantly reduce this risk by fixing the length of pull cords 16 that extends through head rail 12 and between slats 14 to bottom rail 18.

Figure 17:
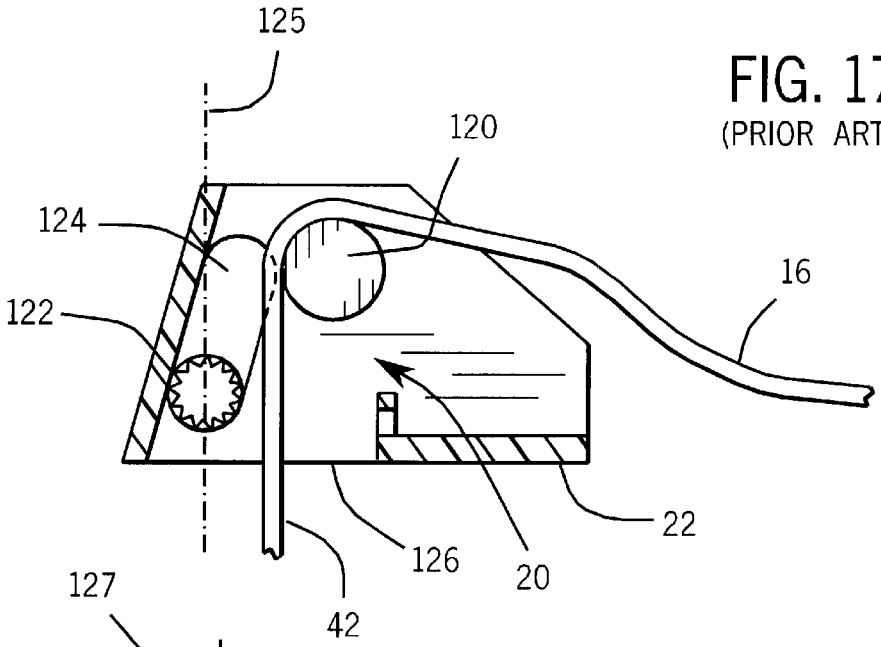
FIG. 17 (PRIOR ART)
FIG. 17 is a front sectional view of a prior art cord lock mechanism.

FIG. 17 illustrates a conventional cord lock mechanism representative of the prior art. Cord lock 20 includes a bearing 120, a frictional slider 122, and at least one slot 124 defined within head rail 12, or alternatively within the cord lock housing, to restrict the movement of friction slider 122 within head rail 12. Slot 124 is defined within head rail 12. In the conventional blind assembly of FIG. 17, slot 124 is disposed to the side of bearing 120 and a portion of slot 124 extends lower than bearing 120. Slot 124 forms a first acute angle with a vertical plane 125 extending through a lower end of slot 124, such that slot 124 inclines slightly from a vertical position toward bearing 120. Slot 124 defines and limits the travel of friction slider 122 within head rail 12 or the cord lock housing.

In the inactivated or unlocked position, illustrated in FIG. 17, friction slider 122 does not contact free end 42 of pull cord 16, thereby enabling pull cord 12 to be pulled from free-hanging section 42 of pull cords 16 or from the section of pull cord extending through slats 14 of blind assembly 10. In order to activate cord lock, the user grasps free-hanging section 42 of pull cord 16 and pulls the cord downward and toward one end of head rail 12 away from bearing 120, thereby positioning free-hanging section 42 of pull cord 16 at least partially beneath and in contact with friction slider 122 causing friction slider 122 to move upward along slot 124 until friction slider 122 engages pull cord 16 and locks pull cord 16 against bearing. The tension on pull cord 16 from the weight of bottom rail 18 pulls friction slider 122 toward bearing 120 thereby locking pull cord 16 between friction slider 122 and bearing 120. The locking of friction slider 122 to pull cord 16 and bearing 120 fixes and prevents movement of pull cord 16. The user unlocks or deactivates cord lock 20 by grasping free-hanging section 42 of pull cord 16 and directing free-hanging section 42 in the opposite direction toward the other end of head rail 12 toward bearing 120, thereby reducing the contact of pull cord 16 with friction slider 122 and disengaging friction slider 122 from bearing 120, enabling friction slider 122 to drop down, under the force of gravity, within slot 124 and away from bearing 120.

Figure 18:
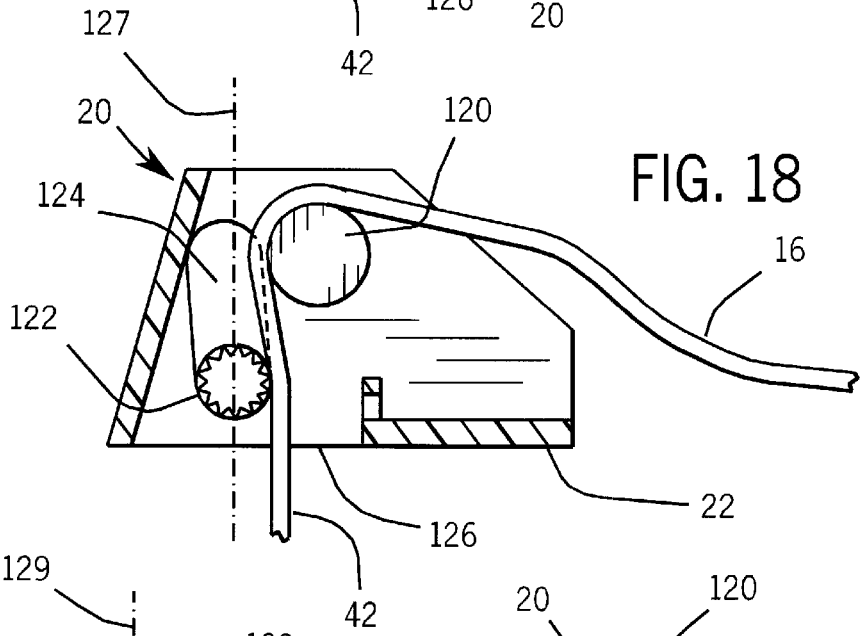
FIG. 18 is a front sectional view of a cord lock of the present invention.

FIG. 18 illustrates the cord lock apparatus of the present invention. Bearing 120 is a cylindrical bearing rotatably connected from a front surface of head rail 12 to a rear surface of head rail 12 or the cord lock housing. In an exemplary embodiment, bearing is rotatably connected to head rail 12 and is positioned within head rail 12 to support pull cords 16 as pull cords 16 extend over and along the side of bearing 120. Alternatively, bearing 120 can include other shapes and can be fixedly connected to or coupled to head rail 12.

Friction slider 122 is a cylindrical member retained within slot 124 of head rail 12. Friction slider 122 is configured to rotatably and slidably extend along slot 124. Friction slider 122 preferably includes a plurality of projecting edges or convolutions outwardly extending from the cylindrical sidewall of friction slider 122 for engaging pull cord 16 when friction slider 122 comes into contact with pull cord 16. Free-hanging section 42 of pull cord 16 is routed upward into opening 126 of head rail 12 where pull cord 16 contacts the side of bearing 120 and extends over bearing 120 and through head rail 12. Bearing 120 provides a support for pull cord 16 and also redirects pull cord 16 from a substantially vertical direction, entering head rail 12, to a substantially horizontal direction, extending along head rail 12.

The lower end of slot 124 is positioned slightly below bearing 120. Slot 124 forms a second acute angle with respect to vertical plane 127 such that slot 124 inclines slightly from a vertical position away from bearing 120. When cord lock 20 is in an inactivated or unlocked position, friction slider 122 is positioned at the lower end of slot 124, which is partially below bearing 120, thereby creating a tortuous path for pull cord 16 such that pull cord 16 is in contact with friction slider 122 prior to extending about and over bearing 120. The contact of pull cord 16 with friction slider 122 prevents pull cord 16 from being pulled from the position between slats 14 of blind assembly 10. Therefore, if blind assembly 10 is in an extended position with bottom rail 18 resting on a sill or other support and cord lock 20 is in an unlocked position, the engagement of friction slider 122 with pull cord 16 prevents a child from pulling pull cord 12 from between and out of slats 14. In alternative configurations, head rail 12 can include limiting devices disposed within or connected to head rail 12 which define the path of travel of friction slider 122 within head rail 12. The limiting devices can include a lower catch, upper and lower catches, etc.

Figure 19:
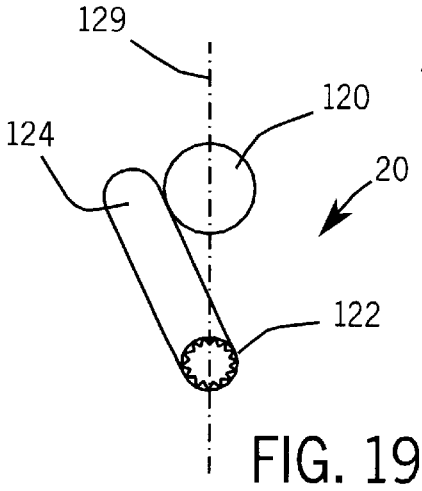
FIG. 19 is a front view of an alternative exemplary embodiment of a cord lock of the present invention.
Figure 20:
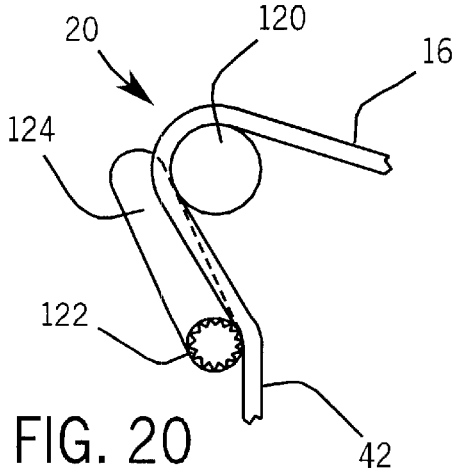
FIG. 20 is a front view of the cord lock of FIG. 19 including a pull cord.

FIG. 19 illustrates an alternative embodiment of cord lock 20 of the present invention. In FIG. 19, the lower end of slot 124 is positioned substantially below bearing 120 such that, when friction slider 122 is at the inactivated or unlocked position at the lower end of slot 124, the center of gravity of friction slider 122 and the center of gravity of bearing 120 lie along the same vertical plane 129. Slot 124 forms a third acute angle with vertical plane 127, such that slot 124 inclines slightly away from bearing 120. The positioning of friction slider 122 substantially below bearing 120, when cord lock 20 is in an unlocked position, results in greater engagement of friction slider 122 to pull cord 16. In the present invention as seen in FIGS. 18 and 20, when pull cord 16 is left in a free-hanging or unlocked position, friction slider 122 remains engaged to pull cord 16, thereby preventing pull cord 16 from being pulled further through head rail 12.

Figure 21:
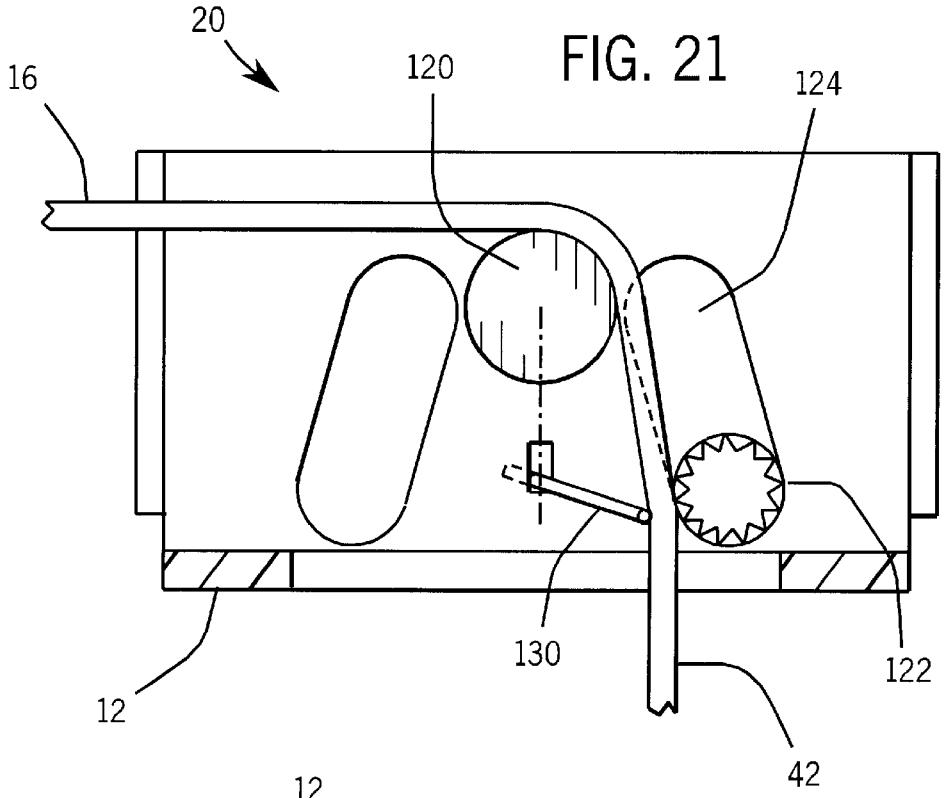
FIG. 21 is a front sectional view of an alternative exemplary embodiment of a cord lock of the present invention.
Figure 22:
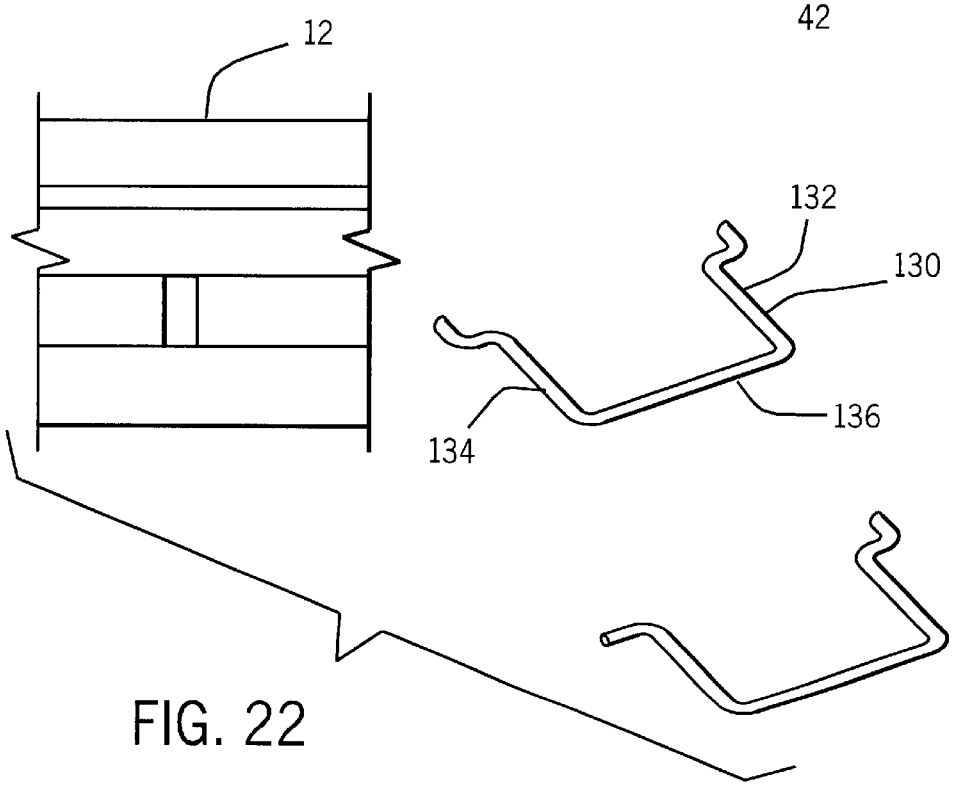
FIG. 22 is a perspective view of a spring of the cord lock of FIG. 21.

FIGS. 21 and 22 illustrate an alternative exemplary embodiment of cord lock mechanism. A biasing device, shown as spring 130, is connected to head rail 12 and is positioned substantially below bearing 120. Spring 130 projects sideways toward slot 124 such that the spring 130 contacts free-hanging section 42 of pull cord 16. In an exemplary embodiment, spring 130 is a generally U-shaped spring having first and second ends 132, 134 connected to head rail 12, and a projecting portion 136 connecting first and second ends 132, 134. Projecting portion 136 is configured to contact pull cord 16. Spring 130 is preferably made of metal. As shown in FIG. 21, slot 124 is positioned adjacent to bearing 120 and a portion of slot 124 extends lower than bearing 120, but not beneath bearing 120. When blind assembly 10 is in an extended position and cord lock 20 is in an unlocked position, spring 130 bears against free-hanging section 42 of pull cord 16 causing pull cord 16 to engage friction slider 122. The engagement of pull cord 16 to friction slider prevents pull cord 16 from being further pulled through head rail 12 and thereby prevents a child from pulling pull cord 16 out from between slats 14 of blind assembly 10.

It should be understood that the foregoing description is of preferred exemplary embodiments of this invention, and that the invention is not limited to the specific forms shown. For example, wherever a single pull cord is referenced, two or more pull cords can also be used. Further modifications may be made in the design, arrangement and combination of the elements without departing from the scope of the invention as expressed in the appended claims.

What is claimed is:

1. A method of preventing the further extension of a pull cord from a blind assembly positioned in an extended position with a bottom rail of the blind assembly resting on a support, the method comprising the steps of:

obtaining a member sized larger than a pull cord passageway of a head rail of the blind assembly;

positioning one of opposing first and second ends of the member adjacent to a mid-section of the pull cord;

pinching the mid-section of the pull cord;

inserting the pinched portion of the mid-section through an opening defined in the member, the opening extending along an axis from the first end to the second end of the member;

forming a loop with the pinched portion of the mid-section and the member;

inserting a free end of the pull cord through the loop;

pulling on the free end to form an adjustable knot in the pull cord with the member; and adjusting the knot to a desired position along the pull cord.

2. The method of claim 1, wherein the opening of the member is cylindrical.

3. The method of claim 1, wherein the member is selected from the group consisting of a washer, a bead, a ring, a band, a cone, a star, a cube and a tube.

4. The method of claim 1, wherein the member has a decorative outer surface.

* * * * *